6/24/80 XR 4,209,778

United States Patent [19]

Wehde et al.

[11] 4,209,778

[45] Jun. 24, 1980

[54] YARN MONITORING APPARATUS FOR AN OPEN-END SPINNING TURBINE

[75] Inventors: Heinz Wehde, Rothenberg; Fritz Schumann; Burkhard Wulfhorst, both of Ingolstadt, all of Fed. Rep. of Germany

[73] Assignee: TELDIX GmbH, Heidelberg, Fed. Rep. of Germany

[21] Appl. No.: 862,046

[22] Filed: Dec. 19, 1977

[30] Foreign Application Priority Data

Dec. 14, 1977 [DE] Fed. Rep. of Germany ..... 2755624

[51] Int. Cl.[2] ..... D01H 13/14; D01H 13/22; G08B 21/00

[52] U.S. Cl. ..... 340/677; 57/81; 57/264; 57/265; 73/160; 73/660; 66/163; 340/682

[58] Field of Search ..... 340/677, 679, 682, 683; 57/81, 100, 264, 265; 73/160, 593, 660; 66/157, 158, 163

[56] References Cited

U.S. PATENT DOCUMENTS

| | | | |
|---|---|---|---|
| 2,009,997 | 8/1935 | Germond | 73/593 |
| 3,678,493 | 7/1972 | Shuey | 340/682 X |
| 3,681,978 | 8/1972 | Mathias et al. | 73/660 |
| 3,974,665 | 8/1976 | Rencin et al. | 340/677 X |
| 3,979,739 | 9/1976 | Birchall | 340/683 X |
| 4,158,284 | 6/1979 | Wehde | 57/81 X |

*Primary Examiner*—John W. Caldwell, Sr.
*Assistant Examiner*—Joseph E. Nowicki
*Attorney, Agent, or Firm*—Spencer & Kaye

[57] ABSTRACT

In the production of yarn in an open-end spinning turbine having an elastically mounted rotor bearing, a break in the yarn or an operating state which influences yarn quality is detected by means of a sensor which produces a signal representative of radial deflections of the bearing and an evaluation circuit which responds to the absence of and/or a change in the signal component produced by the sensor as a result of radial deflections created by the fiber material present on the rotor.

12 Claims, 7 Drawing Figures

YARN MONITORING APPARATUS FOR AN OPEN-END SPINNING TURBINE

BACKGROUND OF THE INVENTION

The present invention relates to an apparatus for monitoring the yarn being removed from an open-end spinning turbine whose rotor is mounted in the machine in an elastically mounted bearing and in which there is associated with the rotor and/or the bearing at least one sensor which responds to radial deflections of its associated part and whose signals are fed to an evaluation circuit to generate a signal, as disclosed in a copending application entitled APPARATUS FOR MONITORING THE YARN PRODUCED BY AN OPEN-END SPINNING TURBINE, filed by Heinz Wehde on about the same date as the present application and claiming priority of German Application P 26 57 525.7 of Dec. 18th, 1976.

The invention disclosed therein is based on the fact that even limited deposits of dirt in the rotor of an open-end spinning turbine give rise to an imbalance. With an elastically mounted rotor, or a rotor which is mounted so as to elastically align its geometrical axis with the axis of inertia, respectively, the rotor rotates supercritically about its major axis of inertia. If the rotor possesses an imbalance, this axis of inertia no longer coincides with the rest position of the rotor axis; rather this axis traces a conical or cylindrical path which is concentric with the rotor axis rest position. Projected onto a plane through the axis rest position, the movements of the axis and of the bearing have the form of oscillations which can be measured with known sensors. The amplitude of these oscillations depends on the extent, or magnitude, of the imbalance.

By selecting a threshold value for those signals generated by the oscillations which will be processed, the signals created by dirt deposits can be extracted from the complete signal stream.

As already indicated, the bearing or rotor oscillation amplitude can be used as a measuring criterion. Another possibility is to sense the oscillation velocity, or rate of change of position of the bearing, which is of course also dependent on the oscillation amplitude, this representing another way of distinguishing between signal values having different causes.

With this imbalance measurement according to the pending application, the yarn is monitored with respect to irregularities. If a number of irregularities occur per unit time at regular intervals, this can be evaluated as an indication that a moire effect will be present in fabric produced from the yarn. However, thickened portions occurring at irregular intervals can also be detected and prevented.

SUMMARY OF THE INVENTION

It is an object of the present invention to adapt this simple measuring technique to other monitoring applications.

This and other objects are accomplished according to the present invention, by constructing the evaluation circuit to generate a signal in response to the absence of and/or change in the signal at the frequency of the spinning imbalance due to the fiber material being spun and by evaluating this signal to determine whether it indicates a break in the yarn or an operating state which would influence the quality of the yarn.

Yarn monitors per se are known. In prior art arrangements, a sensor is provided which operates, for example, optically or mechanically and which monitors the presence of yarn in the removal path from the spinning turbine.

The present invention has the advantage over prior art arrangements that it detects a break in the yarn with very simple means. The invention is based on the realization that in the operating state of the rotor spinning unit, the fiber material being processed produces an imbalance, referred to herein as the spinning imbalance which rotates at a rate different from that of the rotor rotation rate.

This spinning imbalance results from the fact that the fibers deposited in the fiber collection trough of the rotor are not distributed uniformly around the rotor circumference. Rather the fiber quantity increases progressively toward the point where the fibers are bound into the yarn, i.e. the point where the resulting yarn substantially incorporates all of the fibers. Immediately following this point, which will be referred to herein as the binding-in point, where the mass of fibers is greatest, there is a point on the circumference of the rotor which is almost free of fibers, and this latter point defines the end of the yarn being formed which still consists of untwisted fibers. From this point, the yarn being formed steadily increases in thickness until it reaches the binding point where it has the thickness corresponding to the yarn number. Thus, the location of the binding point constitutes the location of the source of the spinning imbalance.

Corresponding to the delivery speed of rovings to the spinning turbine, the binding point travels within the rotor normally in the direction of rotation of the rotor so that the frequency $f_s$ of the spinning imbalance differs from the rotor rate of rotation, $f_R$, and when the binding point is ahead in movement, is greater than $f_R$.

The frequency $f_s$ of the spinning imbalance thus is calculated as follows:

$$f_s = f_R\left(1 \pm \delta \frac{1000}{d\pi\alpha\sqrt{Nm}}\right)$$

where $f_s$ is the spinning imbalance rotation rate, in hertz, $f_R$ is the rate of rotation of the rotor, in hertz, d is the rotor diameter, in mm, $\alpha$ is the coefficient of twist, Nm the fineness of the yarn, in m/g, and $\delta$ is an expansion factor having a magnitude of almost 1 and preferably determined empirically. The plus sign is applicable when the travel of the spinning imbalance is in the sense of rotation of the rotor, the minus sign is applied in the case where the binding point of the yarn travels backward in the rotor trough relative to a point on the rotor assumed to be fixed.

If there occurs a break in the yarn, the yarn removal process is interrupted and, due to this, the travel of the spinning imbalance relative to the rotor ceases. Therefore, if the sensor output indicates that the spinning imbalance has the same rotation rate as the rotor, this indicates a break in the yarn. If the sensor notes, however, a rate $f_s$ less than $f_R$, this means that the binding point is traveling backward relative to the rotor and thus there is a malfunction.

Most of the time the rotor will have its own inherent, or residual, imbalance so that from the superposition of this, practically always present, rotor imbalance and the spinning imbalance there results a beat at a difference frequency. If this beat, i.e. a signal at this difference frequency, disappears, this is a sign that there no longer is any spinning imbalance, i.e. the yarn has broken. A certain maximum residual rotor imbalance is set, for example, by maintenance of appropriate tolerances during manufacture of the rotor.

Another method of measuring the frequency of the spinning imbalance is to superpose, in a mixer stage, a signal at a frequency corresponding to the rate of rotor rotation on the sensor signal which is produced by the spinning imbalance and possibly by an imbalance such as the residual rotor imbalance rotating at the speed of the rotor. The resulting difference frequency is unequal to zero only for the sensor signal component originating from the spinning imbalance, i.e. the presence of a signal at a frequency other than zero is an indication of the existence of spinning imbalance and thus that yarn is being formed and removed. Upon occurrence of a break in the yarn, this signal disappears.

This above-described measuring method is of particular interest if a signal whose frequency corresponds to the speed of rotation of the rotor is present for other reasons, e.g. to commutate the drive voltage of the spinning rotor when the rotor is driven by a brushless d.c. motor.

These measuring methods can be coupled with monitoring of a drop in the motor current by a given amount if the spinning rotor is driven by means of a motor assigned only to this rotor, particularly a brushless d.c. motor. When there is a break in the yarn, the motor current decreases due to the decreased braking moment, or load, acting on the rotor. A drop in the motor drive current by a given amount can be utilized to form a signal whose simultaneous or alternate occurrence together with the signal occurring upon the disappearance of the spinning imbalance is then evaluated as indicating a break in the yarn.

DESCRIPTION OF THE PREFERRED EMBODIMENTS

Figure 1:
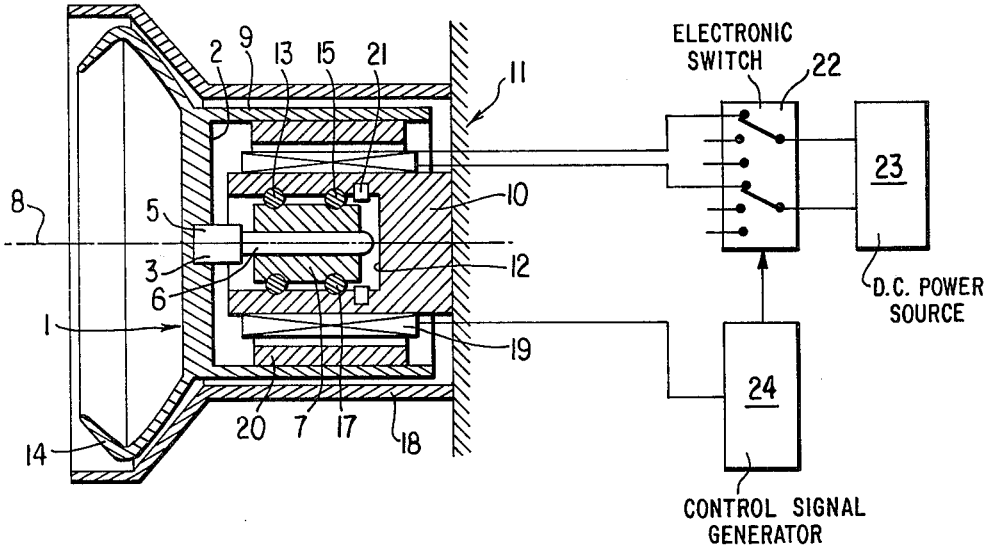
FIG. 1 is partly a cross-sectional side elevational view of a spinning turbine equipped with an elastically mounted rotor bearing and partly a schematic diagram of a drive power source for the turbine motor, constituting apparatus to which the invention can be applied.

FIG. 1 shows an open-end spinning turbine equipped with its own drive system and an elastically mounted bearing for the rotor, which is exemplary of the type of spinning turbine in which the present invention can be used.

The turbine includes a rotor 1 provided with a cup-shaped or bell-shaped part 9 which has a bore 3 at the center of its base 2. In the bore 3 a pin 5 is positioned, and the free end 6 of the pin projects into a bearing bush 7. Free end 6 and bush 7 together constitute a journal bearing, the bush being the stationary part of the bearing and end 6 being the rotary part thereof. The center of gravity of the rotor is located at least approximately on its axis of symmetry 8, and in the region of the journal bearing, which includes the bearing bush 7 and the end 6. A part 10 of a stator 11 projects into the cup-shaped rotor part 9, and has a bore 12 to accommodate the bearing bush 7. The bearing bush 7 is elastically supported in the bore 12 by means of parts of elastic material which are constructed as O-rings 13. These O-rings lie in annular grooves 15 in the interior surface of the bore 12, as well as in annular grooves 17 in the outer surface of the bearing bush 7. Instead of O-rings, a spiral spring (not shown) can be used, one end of the spring lying preferably against the bore 12 and the other end lying against the bearing bush 7. The portion of pin 5, 6 projecting from base 2 is axially shorter than cup-shaped portion 9 so that the latter will provide protection for the pin when the rotor is removed from the stator.

An electric motor is provided for driving the rotor 1. To this end substantially radially magnetized permanent magnets 20 are positioned on the inner surface of the cup-shaped part 9 of rotor 1. The permanent magnets 20 have an alternating polarity in the peripheral direction and are fastened to the rotor as individual magnets.

Windings 19 are provided on the opposite face of the stator part 10 and are associated with the permanent magnets. A current is caused to flow through the windings so that the rotor is driven, for example, like a brushless direct current motor. The windings 19 are constructed without iron so as to prevent additional forces or moments from being generated which can act on the bearing and which would otherwise be present in an electric motor constructed in this way.

The front end of the rotor (to the left in FIG. 1) is constructed to have a funnel-like form 14. When using this device in spinning frames, or turbines, operating according to the open-end method, the material to be spun is introduced into the funnel-like front end of the rotor and drawn off in a known manner. If, for example, as a result of manufacturing tolerances or of the material located in the funnel 14, the center of gravity of the rotor is not located exactly on the axis of symmetry 8, the rotor can still rotate about its largest central principal axis of inertia adjacent axis 8 because of the floating bearing which is provided as above described, thereby preventing creation of additional bearing forces.

The importance of the construction of the drive motor as an iron-free electric motor is then enhanced in that it also ensures that no additional radial forces or moments are exerted on the bearing even by the drive itself, that is to say, even if the rotor does not rotate exactly about the axis 8. In order to reduce drive losses due to the air resistance, which occur particularly at high speed, the rotor is surrounded on its outside by a stationary housing 18.

The stator windings 19 of the brushless d.c. motor driving the spinning rotor is constructed as a three-phase drive winding receiving drive voltage from a d.c. source 23 via an electronic commutator 22. For reasons of simplicity the connections between only one phase of winding 10 and the commutator are shown. Commutation is effected in a known manner by means of an auxiliary winding disposed within the drive winding and by the action of a control signal generator 24 connected between that auxiliary winding and commutator 22.

Mounted in stator member 10 is a sensor 21 which is constructed and mounted to sense the oscillatory radial deflections experienced by the elastically mounted bearing bush 7 in a plane through axis 8.

Figure 2:
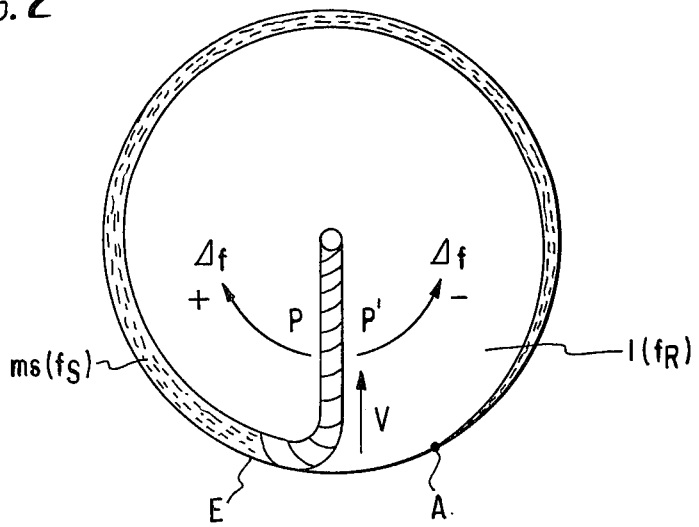
FIG. 2 is a simplified pictorial, axial view illustrating the spinning conditions in the spinning rotor.

The spinning conditions in the rotor 1 are depicted in FIG. 2. From a point A to which rovings are delivered the fiber mass continuously increases around the circumference of the rotor fiber collection trough and reaches a maximum at the binding point E, where the fibers are removed from the rotor circumference by the resulting yarn, the latter being removed from the rotor 1 at a linear speed v. At point E the fiber mass has a thickness which corresponds to the yarn denier, or number. Continuing in the same direction around the rotor periphery, the path between the binding point E and the point A is substantially free of fibers. Due to these conditions the center of mass of the fiber material lies approximately at the point ms in FIG. 2 and constitutes the source of a spinning imbalance.

With rotor 1 rotating clockwise, with respect to the view of FIG. 2, and under normal operating conditions, the binding point E travels, due to the removal of yarn, relative to the rotor in the same sense as the sense of rotation of the rotor, i.e. in the direction of arrow P relative to a reference point on rotor 1, and rotates, as does the resulting yarn leaving the rotor and the center of mass ms of the fiber material collected around the rotor circumference, at the rate $f_s$. In contradistinction thereto the rotor 1 rotates at a rate $f_R$, where $f_R < f_s$. The difference frequency between a point on the rotor assumed to be fixed and the binding point E is thus $\Delta f = f_s - f_R$.

When binding point E rotates relative to rotor 1 in the direction of arrow P', which is opposite to the direction of rotor rotation, a faulty operating state exists. This produces the difference frequency $\Delta f$, where $f_R < f_s$, called the "negative frequency".

While during travel of the binding point E in the direction of arrow P yarn is produced having the desired yarn number and quality, travel of the binding point E in the direction of arrow P' results in production of a faulty yarn. Such yarn has less stability, particularly since the individual fibers are not properly bound in. Such an operating state is particularly disadvantageous if there is no break in the yarn and the faulty yarn continues to be produced and wound onto bobbins without being noticed.

Figure 3:
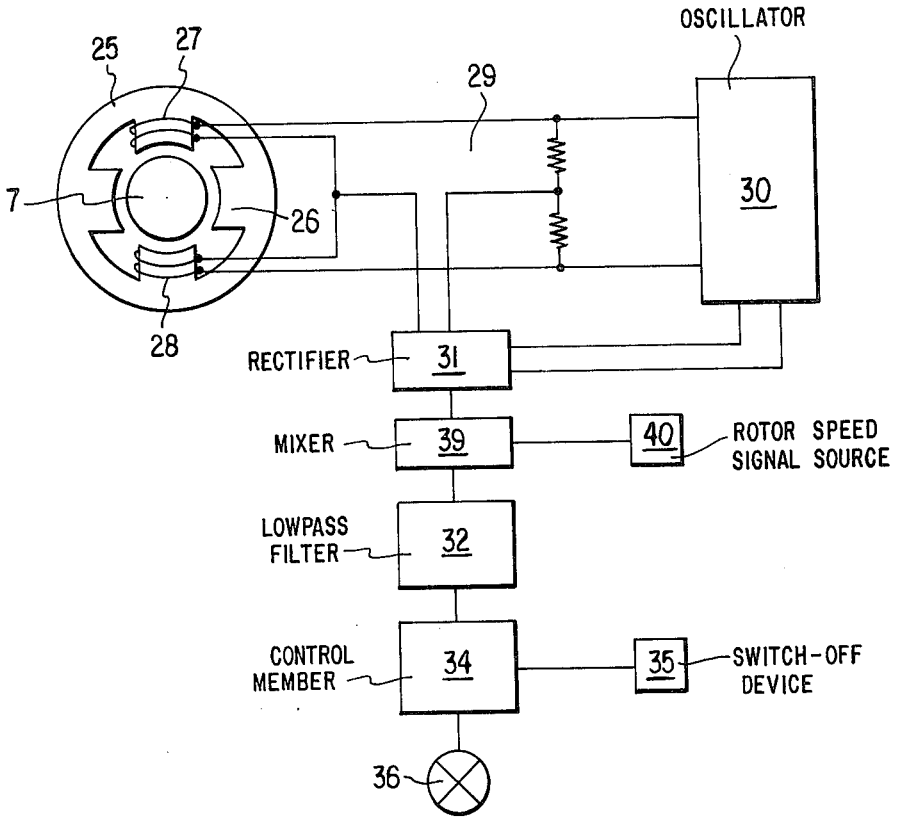
FIG. 3 is a circuit diagram of a measuring arrangement according to the invention for measuring the amplitude of the oscillatory radial deflections of the rotor bearing.

FIG. 3 shows an embodiment of a measuring system according to the invention which produces a signal that represents the amplitude of the oscillatory lateral deflections of bearing bush 7. The sensor here includes an iron ring 25 having four poles 26, and windings 27 and 28 wound about respective ones of two oppositely disposed poles. Windings 27 and 28 are connected into a bridge having one pair of diagonals connected across an oscillator 30. If the bearing bush 7, which is made at least in part of ferromagnetic material, oscillates in the plane containing the common axis of the wound poles 26, there will occur mutually oppositely directed changes of inductance in coils 27 and 28.

This change in inductance is converted, with the aid of a phase-sensitive rectifier 31 connected across the other pair of bridge diagonals, and to oscillator 30, into a signal whose frequency corresponds to the frequency of the deflections of the bearing bush 7 in the sensing plane. Oscillator 30 feeds the bridge with a frequency of, e.g., 100 KHz. The signal at the terminal diagonal of the bridge is rectified in block 31. At the output of rectifier 31 there is then obtained the desired signal.

If there is no inherent rotor imbalance, the frequency of this signal is equal to the rate of rotation of the operating imbalance due to fiber material in the rotor, i.e. if the rotor rotates at a rate $f_R$ of 1000 Hz, the signal frequency is, for example, 1,020 Hz, and this is the value of $f_s$. In a mixer stage 39 this signal is superposed with a signal from a source 40 having a frequency which corresponds to the rate of rotation of the rotor. The signal from source 40 may be, for example, the signal from generator 24 of FIG. 1.

The output signal from mixer stage 39 includes a signal component at a difference frequency equal to the difference between the two frequencies fed to the mixer stage, i.e. a signal component at the difference frequency of, for example, 20 Hz. Higher frequency signal components are suppressed in a lowpass filter 32 connected beyond stage 39. The output of filter 32 is fed to a control member 34 which operates in such a manner that upon disappearance of the a.c. signal at the output of member 32 when there is a break in the yarn, the control member supplies a switching signal to a switch-off device 35 to switch off the spinning unit, and a warning signal to lamp 36. The switching signal may also be used, for example, as a control pulse for an automatic rotor cleaning device and an automatic start-spinning and tie-on device.

The difference frequency $\Delta f$ can be defined by the relationship:

$$\Delta f = f_R \frac{1000}{d\pi a \sqrt{Nm}}$$

all of the terms of which are as defined earlier herein.

Due to expansion of the yarn during removal from the rotor, the difference frequency $\Delta f$ may change by the factor $\delta$ where $\delta$ is an expansion factor having a value near 1. The value of $\delta$ is best determined empirically. Thus, the following applies for the difference frequency:

$$\Delta f = \delta \cdot f_R \frac{1000}{d\pi a \sqrt{Nm}}$$

If such a difference frequency $\Delta f$ between an existing rotor imbalance and the spinning imbalance is no longer present in the signal from mixer 39 and filter 32, it is obvious that no yarn is being removed any longer, and this indicates a break in the yarn.

In place of the sensor shown in FIG. 3, a capacitive sensor of a known type may be used or, if a magnet is provided at the bearing, a magnetic field sensitive sensor, such as, for example, a Hall probe or sensor, which undergoes a change in the premagnetization of the core of its coils, or another known sensor to measure a displacement may be used.

Figure 4:
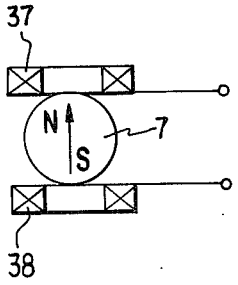
FIG. 4 is a simplified pictorial view of a sensor for measuring the radial deflection speed.

In the embodiment shown in FIG. 4 the bearing bush 7 includes a transversely magnetized portion, as indicated by north and south pole regions, so that pulses are induced in coils 37 and 38 by oscillating radial movements of bush 7. The repetition rate of these pulses corresponds to the bearing deflection frequency. These pulses can be converted to the desired alternating voltage and supplied, for example, to mixer stage 39 of the circuit of FIG. 3.

A further method for determining the difference frequency $\Delta f$ is carried out by conducting the output signal from the sensor through a delay member, which may be digital, and simultaneously superposing the sensor output on the output signal of the delay member. If the delay time is properly selected, e.g. is made equal to $$\frac{1}{2f_R},$$

this normally also provides a signal at the difference frequency, the absence of which indicates a break in the yarn.

The difference frequency obtained as described above and used to detect a break in the yarn can also be used to determine the speed $v_1$ of yarn removal and thus the total length of yarn produced. The difference frequency $\Delta f$ derived by the measuring operation can be processed mathematically as follows:

$$v_1 = \frac{60 \cdot \Delta f \pi d}{\delta}$$

to determine the yarn removal speed in mm/min, where $d\pi$ is the groove circumference in the spinning rotor and $\delta$ is the expansion factor for the yarn which lies near 1. With a corresponding frequency counter and a simple computer or function generator the value $v_1$ can be determined very easily. If the measuring results obtained at uniformly spaced instants are added, the sum is a value which is proportional to the removed length of yarn. For example, if the measured value $$v_2 = \frac{\Delta f \cdot d\pi}{10^3 \cdot \delta}$$

where $v_2$ is yarn speed in meters/second, is summed at intervals of 1 second, a direct value for the yarn removed, in meters, is obtained. This evaluation can be effected digitally, if the measured value is determined in a digital manner.

If the lengths of yarn removed per unit time are summed in the computer up to a given limit value, a pulse can be generated when this limit value has been exceeded and can be used as a control pulse for the actuation of a bobbin changer or for switching on a signal lamp to indicate the necessity of a manual bobbin change when a certain yarn length, which is the same on all bobbins of the machine, has been wound.

Thus, the apparatus according to the invention permits the production of bobbins which always contain identical yarn lengths without consideration of operating malfunctions as a result of yarn breaks at the individual spinning positions, which is of great importance for the further processing of the yarn, particularly when the bobbins are placed onto creels. The otherwise encountered wastes from bobbin remnants can be avoided.

According to a further embodiment of the invention it is possible to detect other faulty operating states through monitoring of the yarn removal speed.

The relationship $$\Delta f = \frac{1000 \cdot v \cdot \delta}{d\pi \cdot 60}$$

where v is the yarn removal speed in m/min, indicates that the difference frequency is a function of the fiber supply and of the rotor diameter. The difference frequency is generally kept constant by the removal of the yarn by means of a pair of delivery rollers, composed of a removal roller and a pressure roller. Upon a change in the removal speed v, as a result, for example, of the yarn becoming wound around the removal roller, the difference frequency $\Delta f$ will change. The change in the difference frequency $\Delta f$ with respect to a change in the speed v of yarn removal can be calculated as follows:

$$\frac{d(\Delta f)}{dv} = \frac{\delta \cdot 1000}{d\pi \cdot 60}$$

where $$\frac{d(\Delta f)}{dv}$$

is the differential quotient of the change in frequency, $d(\Delta f)$, and the change in the removal speed, dv. Relatively greater deviations from a difference frequency $\Delta f_{mid}$, determined during normal spinning operation indicate unintended changes in the removal speed, such as due to the formation of loops of yarn around the removal roller.

On the other hand, the difference frequency $\Delta f$ may also change if the rotor speed $f_R$ deviates from the desired speed due to some malfunction in the rotor drive. A deviation from the desired rotor speed causes faulty twisting of the yarn being spun and this results in the production of yarn of faulty quality. Thus a signal produced by a change in the value of the difference frequency $\Delta f$ also serves to detect faulty operating states, or faulty yarn quality.

A change in the difference frequency value can be determined by known means and a corresponding signal resulting from the change in difference frequency value generates a pulse to switch off the spinning unit or the fiber supply, respectively. For this purpose, for example, digital frequency counters constitute suitable means, the time base or clock pulse rate, depending on the required accuracy.

As has already been mentioned above, a faulty operating state is present also if, under certain operating conditions, the binding point of the yarn travels in the direction P', that is backward in the rotor groove relative to a point on the rotor. The frequency of the operating imbalance for this case is $$f_S = f_R\left(1 - \delta_1 \frac{1000}{d\pi a \sqrt{Nm}}\right)$$

where $\delta_1$ is an expansion factor close to 1. Digital difference frequency counting can be employed to determine whether the frequency of the spinning imbalance is less than the rotor frequency. If such a negative difference frequency is indicated by the frequency counter the counter emits a signal to stop the spinning station. Of course, this signal can also be used, for example, to trigger a visible indication of faulty operating behavior. In this way it is also possible to immediately detect the production and the unnoticed winding of faulty yarn and thus to reliably monitor the yarn quality.

A further embodiment of the invention provides for the continuous determination of fluctuations in the yarn number outside a permissible tolerance range. Such fluctuations in number occur, for example, when there are temporary but long duration flaws in the supply material or if, due to faulty application, double slivers are fed in. Corresponding to the mass of fiber broken up per unit time and the fiber material fed into the rotor groove, the mass of the spinning imbalance and consequently the amount of deflection of the elastically mounted rotor will also change when the removal of yarn from the rotor remains constant.

If during a certain period of time the amplitude of the spinning imbalance changes to beyond a permissible tolerance range, this indicates the feeding in of faulty supplies. By suitable measures known in the art, if the amplitude of the spinning imbalance remains above or below a given tolerance value for a certain perod of time, this can be determined and a pulse can be generated to actuate a warning or switching-off signal. In this way the appearance of unacceptable deviations in the yarn number can be detected and corrected.

Figure 5:
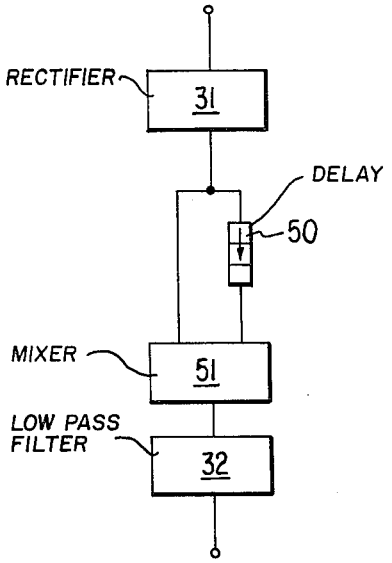
FIG. 5 is a block diagram which can be used instead of that of FIG. 3.

The method mentioned above, in which the difference frequency $\Delta f$ is generated by means of a delay member is shown in FIG. 5. There the rectifier 31 and also the lowpass filter 32 of FIG. 3 are shown. The output of rectifier 31 is conducted through the delay member 50 and directly to the mixer 51. When the frequency $f_s$ disappears and there is only present the frequency $f_R$ at the output of rectifier 31, for a time corresponding to the delay time of perhaps 1 sec of delay member 50 a difference frequency $\Delta f$ is still present at the output of mixer 51 and then it disappears.

Figure 6:
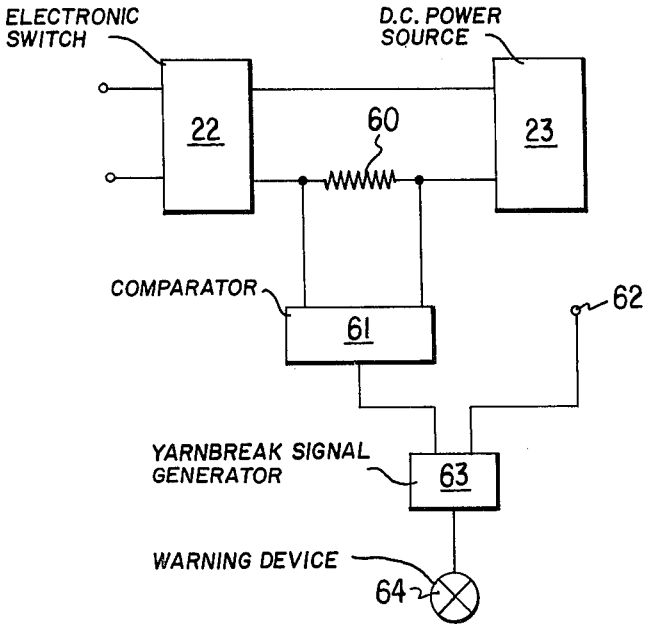
FIG. 6 is a block diagram in which in addition a yarn break signal is generated by means of monitoring current of a motor.

In FIG. 6 the power source and the electronic switch of FIG. 1 are shown again. In the power lead a resistance 60 is inserted and the voltage taken from it is fed to a comparator 61, which generates an output signal, when the voltage from resistance 60 decreases by a given amount, which occurs because of a yarn break. This signal and/or the signal at terminal 62, which may be the output of the control member 34 of FIG. 3 are fed to the block 63 which generates the yarn break signal fed to a warning device 64.

Figure 7:
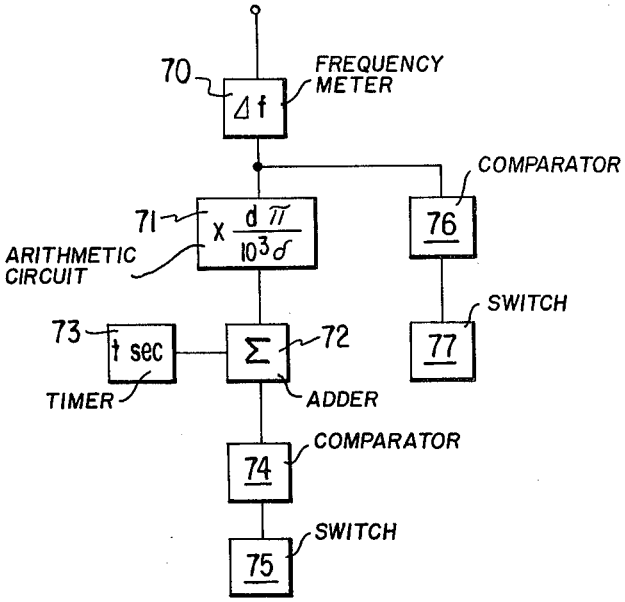
FIG. 7 is a block diagram showing how the different frequency $\Delta f$ can be used to provide a value for the yarn removal speed, the yarn removed and how a change of the difference frequency can be detected.

In FIG. 7 the output of lowpass-filter 32 of FIG. 3 is fed to the frequency meter 70, which determines the frequency of the difference frequency $\Delta f$. In the arithmetic means 71 the frequency $\Delta f$ is multiplied by the factor $$\frac{d\pi}{10^3\delta}.$$

The output of means 71, which may be in digital form and is the removal speed in meters per second, is fed to the adder 72 which because of time member 73—adds the output value of arithmetic means in time intervals of 1 sec. The sum reached in the adder 72 which is the length of the removed yarn is compared in the comparator 74 with a given value and a signal is given to switching-member 75 as soon as this given value is reached for actuating a bobbin changer.

The difference frequency measured in meter 70 may also be compared in comparator 76 with a given value, to determine whether or not the spinning imbalance rotates with a desired value. If the difference frequency exceeds or falls below a given difference, then a switching signal is fed into switching member 77.

With the present invention it is possible to monitor, with a single sensor, the entire yarn production is various ways so that all flaws in the spinning process are detected directly and immediately. The usual yarn monitors as well as a separate winding and cleaning process are eliminated.

The apparatus according to the present invention thus permits perfect quality monitoring to the extent that conventional laboratory measurements which can otherwise be effected only on random samples to control quality are here made automatically and can be evaluated for the entire production line.

It will be understood that the above description of the present invention is susceptible to various modifications, changes and adaptations, and the same are intended to be comprehended within the meaning and range of equivalents of the appended claims.

What is claimed is:

1. A system for monitoring the production of yarn in an open-end spinning turbine, the turbine including a rotor rotatably mounted in a bearing and means elastically supporting the bearing so that the delivery of fiber material to the turbine and the production of yarn therefrom creates a spinning imbalance in the rotor which causes the bearing to undergo an oscillatory radial deflection at a frequency equal to the rate of rotation of the spinning imbalance, the spinning imbalance having, under normal operating conditions, a predetermined rate of rotation, different from the rate of rotation of the rotor, said system comprising: a measuring value sensor disposed for monitoring the radial deflections of the bearing and producing a measuring signal at least a component of which is representative of the spinning imbalance; and evaluation means connected to receive at least that component of the measuring signal which is representative of the spinning imbalance and responsive to a change in the frequency of such signal component for providing an indication of the occurrence of a deviation from normal operating conditions constituted by at least a break in the yarn of an operating state which adversely influences yarn quality.

2. An arrangement as defined in claim 1 wherein said evaluation means comprise: a member connected to produce a difference frequency signal having a frequency equal to the difference between the frequency of such measuring signal component and the rate of rotor rotation; and switching means connected for switching off the turbine upon disappearance of the difference frequency signal.

3. An arrangement as defined in claim 2 wherein: the rotor of the spinning turbine possesses an inherent imbalance which causes the radial deflection movement of the bearing to have a rotor imbalance component with a frequency equal to the rate of rotor rotation; the measuring signal produced by said sensor includes a component corresponding to such rotor inbalance component; and said member includes a best frequency deriving device connected to receive the output signal from said sensor.

4. An arrangement as defined in claim 2 wherein said member comprises a mixing stage connected to mix the output signal from said sensor with a comparison signal having a frequency equal to the rate of rotor rotation.

5. An arrangement as defined in claim 4 wherein the turbine includes an individual brushless d.c. drive motor connected to drive the rotor, a commutation device for supplying drive current to the motor, and control means for deriving a control signal from the motor and having a frequency corresponding to the rate of rotor rotation of the rotor said, control means delivering such control signal to the commutation device for controlling the operation thereof and to said mixing stage as the comparison signal.

6. An arrangement as defined in claim 2 wherein said member includes a time delay device connected to receive the measuring signal from said sensor, and a combining device connected to combine the output signal from said delay device with the measuring signal from said sensor.

7. An arrangement as defined in claim 1 wherein: the turbine includes an individual motor connected to drive the rotor and operating with a current consumption proportional to the mechanical load against which it operates; said evaluation means provide an indication of the absence of a spinning imbalance having the predetermined rate of rotation; and said system further comprises current monitoring means connected to provide an output signal when the current consumption of said motor falls below a selected value, and means connected to said evaluation means and to said current monitoring means to provide a yarn break signal upon the simultaneous or alternating appearance of the indication of the absence of such spinning imbalance and the output signal from said current monitoring means.

8. An arrangement as defined in claim 1 wherein the turbine rotor has a fiber collection trough in which fibers are collected during production of yarn, said evaluation means provides a signal representative of the difference between the rate of rotation of the spinning imbalance and the rate of rotation of the rotor, and said system further comprises arithmetic means connected to receive such signal from said evaluation means and providing a representation of the mathematical result of multiplication of the difference represented by such signal and the fiber collection trough diameter and division of the multiplication product by an empirically determined yarn expansion factor having a value in the vicinity of unity.

9. An arrangement as defined in claim 1 wherein said evaluation means provide a difference frequency signal at a frequency equal to the difference between the rate of rotation of the spinning imbalance and the rate of rotation of the rotor, and said system further comprises means connected to receive such difference frequency signal, to produce representations of the value of the difference frequency at uniformly spaced moments, and to form a sum of such representations in order to provide an indication or the total length of yarn produced.

10. An arrangement as defined in claim 9 wherein said means connected to receive the difference frequency signal produce the representations of the value of the difference frequency in digital form and include digital signal processing means for forming the sum of such representations.

11. An arrangement as defined in claim 1 wherein said evaluation means produce a difference frequency signal at a frequency equal to the difference between the rate of rotation of the spinning imbalance and the rate of rotation of the rotor, and said evaluation means include a switching member connected to respond to deviations in the value of the difference frequency from that associated with normal operating conditions in order to shut off at least one of the operation of the turbine and the supply of fiber thereto upon the occurrence of such deviation.

12. An arrangement as defined in claim 1 wherein said evaluation means are responsive to a deviation in the amplitude of the spinning imbalance by a selected amount from the predetermined amplitude during a given period of time and provide an indication upon the occurrence of such deviation.

* * * * *